US008850722B2

(12) United States Patent
Baker et al.

(10) Patent No.: US 8,850,722 B2
(45) Date of Patent: Oct. 7, 2014

(54) ARTICLE OF FOOTWEAR WITH A REMOVABLE HEEL MEMBER

(75) Inventors: Brian D. Baker, Portland, OR (US); Neil Crumbleholme, Portland, OR (US); Vernon J. Hentz, III, Tigard, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 1364 days.

(21) Appl. No.: 12/183,725

(22) Filed: Jul. 31, 2008

(65) Prior Publication Data

US 2010/0024248 A1 Feb. 4, 2010

(51) Int. Cl.
*A43B 3/26* (2006.01)
*A43B 3/00* (2006.01)

(52) U.S. Cl.
CPC ..... *A43B 3/26* (2013.01); *A43B 3/0031* (2013.01)
USPC ..... 36/97; 36/58.6; 36/92; 36/105; 36/136

(58) Field of Classification Search
USPC ..... 36/58.5, 58.6, 97, 92, 105, 112, 100, 36/132, 136, 69, 71, 68, 70 R
See application file for complete search history.

(56) References Cited

U.S. PATENT DOCUMENTS

| | | | | |
|---|---|---|---|---|
| 902,929 | A | 11/1908 | Telford | |
| 1,176,572 | A * | 3/1916 | Lassig | 36/1 |
| 1,548,172 | A * | 8/1925 | Redden | 36/89 |
| 1,749,084 | A | 3/1930 | McCarthy | |
| 1,926,818 | A | 9/1933 | Ratcliff | |
| 1,966,179 | A | 7/1934 | Lesch | |
| 2,742,715 | A * | 4/1956 | Meltzer | 36/100 |
| 3,431,658 | A | 3/1969 | Finn | |
| 3,758,964 | A | 9/1973 | Nishimura | |
| 3,810,318 | A | 5/1974 | Epstein | |
| 4,712,319 | A | 12/1987 | Goria | |
| 4,726,126 | A * | 2/1988 | Bernhard | 36/89 |
| 4,783,911 | A | 11/1988 | Brown | |
| 4,817,306 | A * | 4/1989 | Bayer | 36/136 |
| 4,869,001 | A | 9/1989 | Brown | |
| 5,113,526 | A * | 5/1992 | Wang et al. | 2/2.5 |

(Continued)

FOREIGN PATENT DOCUMENTS

| | | |
|---|---|---|
| EP | 0528130 | 2/1993 |
| FR | 2149963 | 3/1973 |

OTHER PUBLICATIONS

International Search Report and Written Opinion mailed Apr. 27, 2010 in PCT Application No. PCT/US2009/050761.

(Continued)

*Primary Examiner* — Jila M Mohandesi
*Assistant Examiner* — Tiffany Drake
(74) *Attorney, Agent, or Firm* — Plumsea Law Group, LLC

(57) ABSTRACT

A sizing system for an article of footwear includes an insert attachable to the upper of the article of footwear. The insert is positioned within a pocket formed between the lining of the upper and the exterior shell of the upper. When attached to the upper, the insert forms a part of the exterior surface of the article of footwear. When the insert is removed, part of the pocket forms a portion of the exterior surface of the article of footwear or a flap is extended over the pocket to form a portion of the exterior surface of the article of footwear. The insert may be secured within the pocket using a mechanical fastener.

22 Claims, 18 Drawing Sheets

(56) References Cited

U.S. PATENT DOCUMENTS

| | | | | |
|---|---|---|---|---|
| 5,136,726 | A | 8/1992 | Kellin et al. | |
| 5,230,333 | A * | 7/1993 | Yates et al. | 607/111 |
| 5,265,349 | A * | 11/1993 | Munschy | 36/97 |
| 5,430,961 | A | 7/1995 | Faulconer et al. | |
| 5,606,808 | A * | 3/1997 | Gilliard et al. | 36/89 |
| 5,740,618 | A | 4/1998 | Minden | |
| D398,146 | S * | 9/1998 | Herndon | D2/970 |
| 5,974,590 | A | 11/1999 | Stubbs | |
| 6,082,027 | A | 7/2000 | Wagonhurst | |
| 6,101,655 | A | 8/2000 | Buddle | |
| 6,442,874 | B1 | 9/2002 | Long | |
| 6,442,875 | B1 | 9/2002 | Joubert et al. | |
| 6,584,707 | B1 | 7/2003 | Racine et al. | |
| 6,804,901 | B2 | 10/2004 | Joubert et al. | |
| 6,920,707 | B1 | 7/2005 | Greene et al. | |
| 7,028,417 | B2 * | 4/2006 | Tingle | 36/9 R |
| 7,168,188 | B2 | 1/2007 | Auger et al. | |
| 7,293,370 | B2 * | 11/2007 | Kaplan et al. | 36/8.4 |
| 2004/0049951 | A1 | 3/2004 | Chen | |
| 2006/0213087 | A1 | 9/2006 | Gallegos | |
| 2007/0039208 | A1 | 2/2007 | Bove et al. | |
| 2007/0039209 | A1 | 2/2007 | White et al. | |
| 2009/0249649 | A1 | 10/2009 | Schenone | |

OTHER PUBLICATIONS

International Preliminary Report on Patentability (including Written Opinion of the ISA) mailed Feb. 10, 2011 in International Application No. PCT/US2009/050761.

Notification of the Decision to Grant dated Dec. 3, 2012 in Chinese Patent Application No. 200980138372.8 with English Translation.

Chinese Office Action dated Feb. 29, 2012 in Chinese Patent Application No. 200980138372.8 with English Translation.

Response to the Chinese Office Action filed Jul. 16, 2012 in Chinese Patent Application No. 200980138372.8 with English Translation.

Office Action dated Mar. 14, 2011 in European Patent Application 09802243.7.

Office Action Response filed Apr. 21, 2011 in European Patent Application 09802243.7.

* cited by examiner

ARTICLE OF FOOTWEAR WITH A REMOVABLE HEEL MEMBER

BACKGROUND OF THE INVENTION

1. Field of the Invention

The present invention relates to size-adjustable footwear, and more particularly an article of footwear with a removable insert configured to alter the size of the article of footwear.

2. Description of Related Art

As children grow, numerous pairs of shoes in increasing sizes are required to accommodate their growing feet. Often, children outgrow shoes before receiving much use from the shoes. Therefore, parents invest a significant amount of money replacing shoes for their growing child. This problem is magnified for certain types of shoes worn for specific occasions or seasons, such as dress shoes or snow boots.

To avoid the cost of replacing shoes on a frequent basis, some parents might purchase shoes in sizes larger than their children's feet to allow the children to grow into them. Other parents may have their children wear a pair of shoes even though the child has outgrown them. Neither of these practices are desirable because the shoes will not likely fit properly, possibly causing podiatric problems.

Typically, most children's feet grow approximately one full shoe size per year, or one-half shoe size every four to six months. Consequently, larger shoes are purchased frequently to accommodate the growing foot size. This frequent shoe purchasing may be financially burdensome for families. Thus, providing a system for allowing multiple foot sizes to fit properly within the footwear would be advantageous to extend the life of footwear by accommodating a growing foot. Additionally, providing footwear that fits properly over many foot sizes may eliminate the potential for the onset of podiatric problems due to improper fit of the footwear.

Several solutions have been proposed to accommodate multiple foot sizes with one article of footwear. For example, U.S. Pat. No. 6,442,874 to Long teaches an article of footwear having an adjustable sizing mechanism disposed within the heel of the upper of the article of footwear. The Long invention provides a solution for accommodating multiple foot sizes. Additionally, U.S. Pat. No. 3,431,658 to Finn teaches a shoe having an expandable bellows disposed within the heel region of the shoe. The expandable bellows taught in the Finn invention provides the ability to adjust the length of the shoe to accommodate multiple foot lengths so that the shoe need only be made in a limited number of sizes.

The solutions proposed within the art, while they provide for adjustable sizing of articles of footwear, they do not provide for removal of the adjustable sizing mechanism. This may prove to be disadvantageous when the wearer's foot is large enough to fit within the footwear without any need for an adjustable sizer. As a result, the footwear may become uncomfortable to wear or create irritation points on the heel of the wearer's foot. Furthermore, due to the sizing members within the proposed solutions being a non-removable feature, the footwear may become susceptible to wear during the prolonged use requiring replacement of the footwear.

Therefore, a need exists in the art for a removable sizer for an article of footwear.

SUMMARY OF THE INVENTION

An article of footwear includes a pocket or a flap at a rearward-most position on the heel region. The pocket or flap is configured to receive a sizer, such as a removable portion of material that is capable of changing the effective size of the shoe. The shoe is shortened to a smaller size when the sizer is positioned in the pocket or under the flap. The shoe is lengthened to a larger size when the sizer is removed. The sizer may include an exposed portion upon which a graphic or other symbol or writing may be printed. Thus, the article of footwear may be given a customized appearance by positioning the sizer in the pocket or underneath the flap. Additionally, the exposed portion of the sizer may be decorated or designed to resemble the outer surface of the article of footwear so that the article of footwear has a similar appearance regardless of whether or not the sizer is positioned in the pocket or underneath the flap.

In one aspect, the invention provides a size-adjustable article of footwear having a first effective length when a removable member is positioned within a pocket in a heel portion of the article of footwear and a second effective length when the removable member is removed from the pocket, wherein the removable member forms a portion of an exterior surface of the article of footwear when positioned within the pocket, and wherein a pocket surface forms the portion of the exterior surface of the article of footwear when the removable member is removed from the pocket.

In another aspect, the invention provides an article of footwear comprising an upper comprising an outer shell and a liner disposed at least partially within the outer shell, the liner configured to contact a foot of a wearer, and a pocket formed between the liner and the outer shell in a heel region of the upper, the pocket configured to receive an insert, the insert configured to alter an effective length of the article of footwear.

In another aspect, a method of changing a size of an article of footwear comprises the steps of: providing an article of footwear with a pocket formed between the liner and the outer shell in a heel region of the upper, the pocket configured to receive an insert, the insert configured to alter an effective length of the article of footwear; providing the insert, wherein the insert is configured to be secured within the pocket; positioning the insert within the pocket so that a portion of the insert forms an exterior surface of the article of footwear; and securing the insert within the pocket by engaging a first portion of a mechanical fastener positioned on the insert with a second portion of the mechanical fastener positioned in the pocket.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
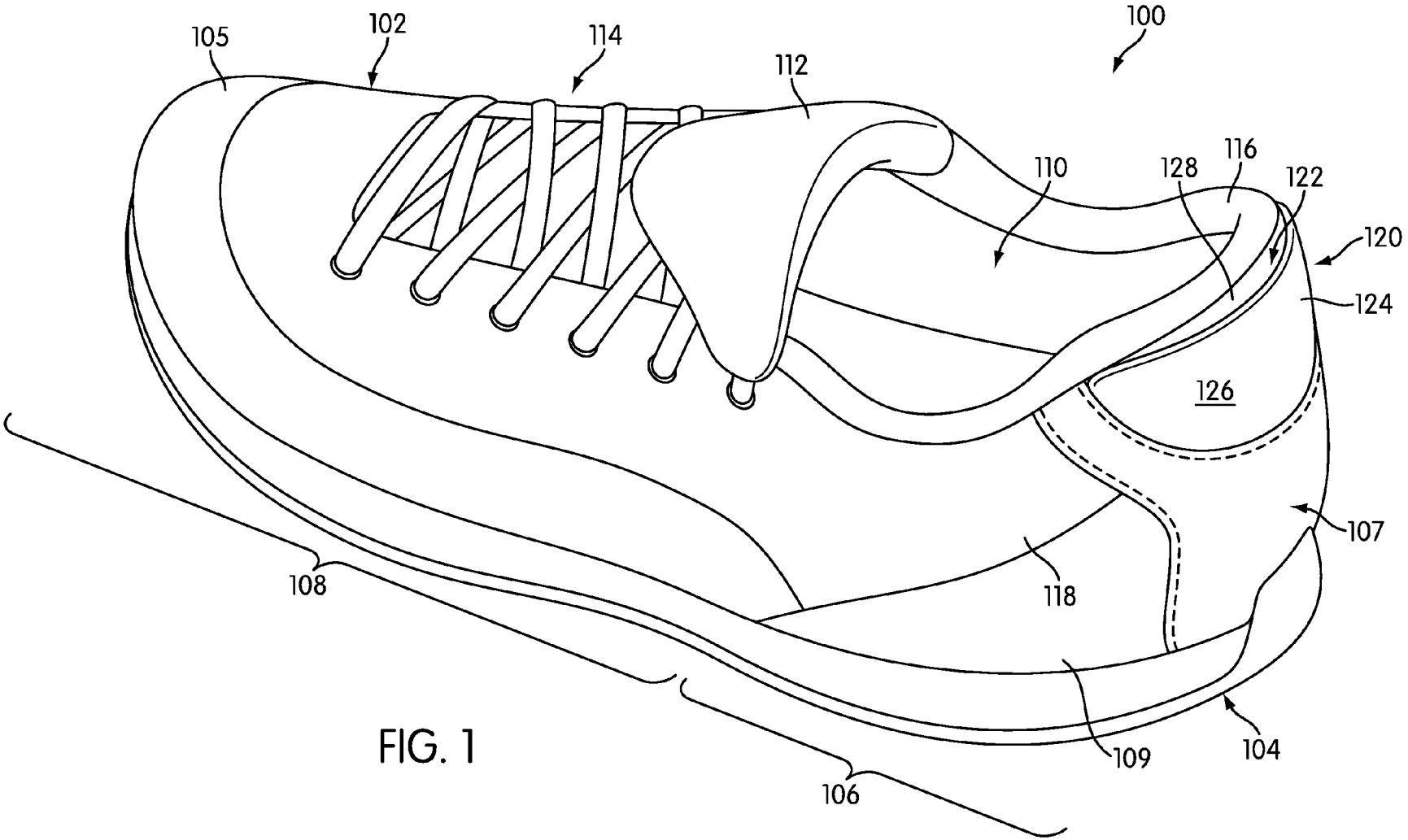
FIG. 1 is a perspective view of a preferred embodiment of a size-adjustable article of footwear having a removable heel member.
Figure 2:
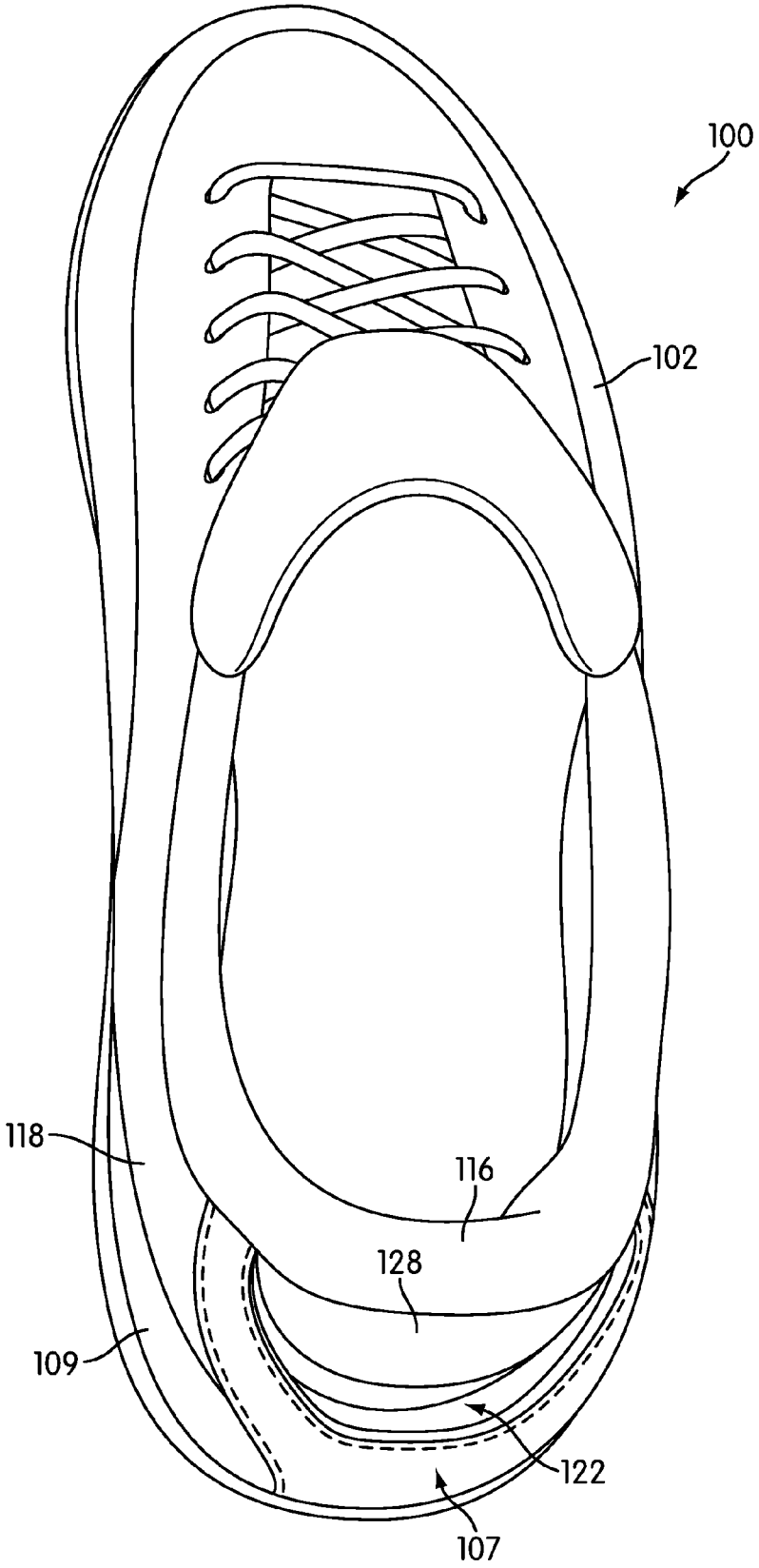
FIG. 2 is a plan view of the size-adjustable article of footwear.

A size-adjustable article of footwear having a removable heel member capable of changing an effective length of the article of footwear is provided. FIGS. 1-11 show one embodiment of a size-adjustable article of footwear 100. While article of footwear 100 is shown as an athletic shoe, article of footwear 100 may be any type of footwear known in the art, provided that the footwear includes a heel region capable of supporting a removable member. In other embodiments, for example, article of footwear 100 may be a dress shoe, a sandal, a moccasin, or the like.

Article of footwear 100 generally includes an upper 102 fixedly attached to a sole 104. Sole 104 is generally configured as a ground-engaging portion of article of footwear 100. In one embodiment, sole 104 is made of a material capable of providing traction against the ground, such as rubber. In some embodiments, sole 104 is a multi-layer sole. Such multi-layer soles are well known in the art, and may include a ground-engaging outsole, a cushioning midsole, and an insole configured to contact a foot.

Upper 102 is preferably sized and dimensioned to receive a wearer's foot through opening 110. Upper 102 generally includes a heel region 106 and a forefoot region 108.

As shown in FIG. 1, upper 102 includes a footwear fastening system 114 disposed in middle region of upper 102 near a tongue 112. In some embodiments, footwear fastening system 114 may be used to tighten upper 102 to a wearer's foot so that the wearer's foot is not readily extracted through opening 110 or loosen upper 102 to ease the extraction or insertion of the wearer's foot into upper 102 through opening 110. Footwear fastening system 114 may be any type of fastening system known in the art. Examples of footwear fastening systems include, but are not limited to, Velcro®, buckles, and zippers. In a preferred embodiment, footwear fastening system 114 includes laces. In other embodiments, no footwear fastening system is provided, such as with a slip-on shoe or sandal.

Upper 102 includes a liner 116 disposed within an exterior shell 118. Liner 116 may be any type of liner known in the art. In one embodiment, liner 116 is made of a woven material made of natural or synthetic fibers that can cushion the foot or wick moisture away from the foot. In another embodiment, liner 116 may be made from a non-woven material, such as leather. In yet another embodiment, liner 116 may include multiple layers, such as a cushioning material covered by another material. For example, liner 116 may include a foam or similar material covered by a woven material, such as nylon fabric, so that the woven material is configured to come into contact with the wearer's foot or sock. Liner 116 is provided generally to maximize comfort for the wearer by wicking moisture away from the foot and cushioning the foot.

Exterior shell 118 is configured to form an exterior surface of upper 102. Generally, exterior shell 118 may be made from any material known in the art used for an upper, including but not limited to natural or synthetic leather, natural or synthetic rubber, natural and synthetic materials such as canvas, nylon, or combinations of these materials. Preferably, exterior shell 118 covers or substantially covers liner 116, so that when worn, no portion or only a small portion of liner 116 is visible.

Exterior shell 118 and liner 116 are preferably fixedly attached to each other using any attachment method known in the art. In one embodiment, liner 116 may be stitched to exterior shell 118. In another embodiment, liner 116 may be secured within exterior shell 118 using an adhesive. In another embodiment, a combination of adhesive and stitching may be used to attach liner 116 and exterior shell 118.

In one embodiment, a heel counter 109 may be fixedly attached to exterior shell 118. Heel counter 109 is a layer positioned in heel region 106 for additional stiffness and wear protection for heel region 106 as well as for aesthetic purposes. Heel counter 109 may be any type of material capable of being fixedly attached to exterior shell 118. Examples of materials for heel counter 109 include leather, vinyl, canvas, or the like. Heel counter 109 may be attached to exterior shell 118 using any method known in the art, such as by stitching or with an adhesive.

Article 100 includes a size adjustment system 120 that is provided to alter an effective length of upper 102 so that the size of article 100 may be changed. In one embodiment, as shown in the figures, a heel cup 107 is provided on exterior shell 118. Heel cup 107 may also be positioned on or over a portion of heel counter 109. Heel cup 107 is preferably made from a stiff material, such as leather, plastic, or a combination of materials, such as leather or vinyl reinforced with a layer of plastic or other stiff material. Heel cup 107 may be attached to exterior shell 118 using any material known in the art, such as by stitching or with an adhesive.

Exterior shell 118 in this embodiment is not fixedly attached to liner 116 in the vicinity of heel cup 107 so that a pocket 122 is formed between exterior shell 118 and liner 116. Pocket 122 may be any size or shape, but in the embodiment shown extends vertically generally to sole 104. Pocket 122 in this embodiment extends in a horizontal direction generally coextensively with heel cup 107. In some embodiments, pocket 122 may extend in a horizontally further or less than heel cup 107. In one embodiment, pocket 122 is positioned generally at or near the back of article footwear 100, i.e., the point on article of footwear 100 that is furthest from toe 105.

Figure 4:
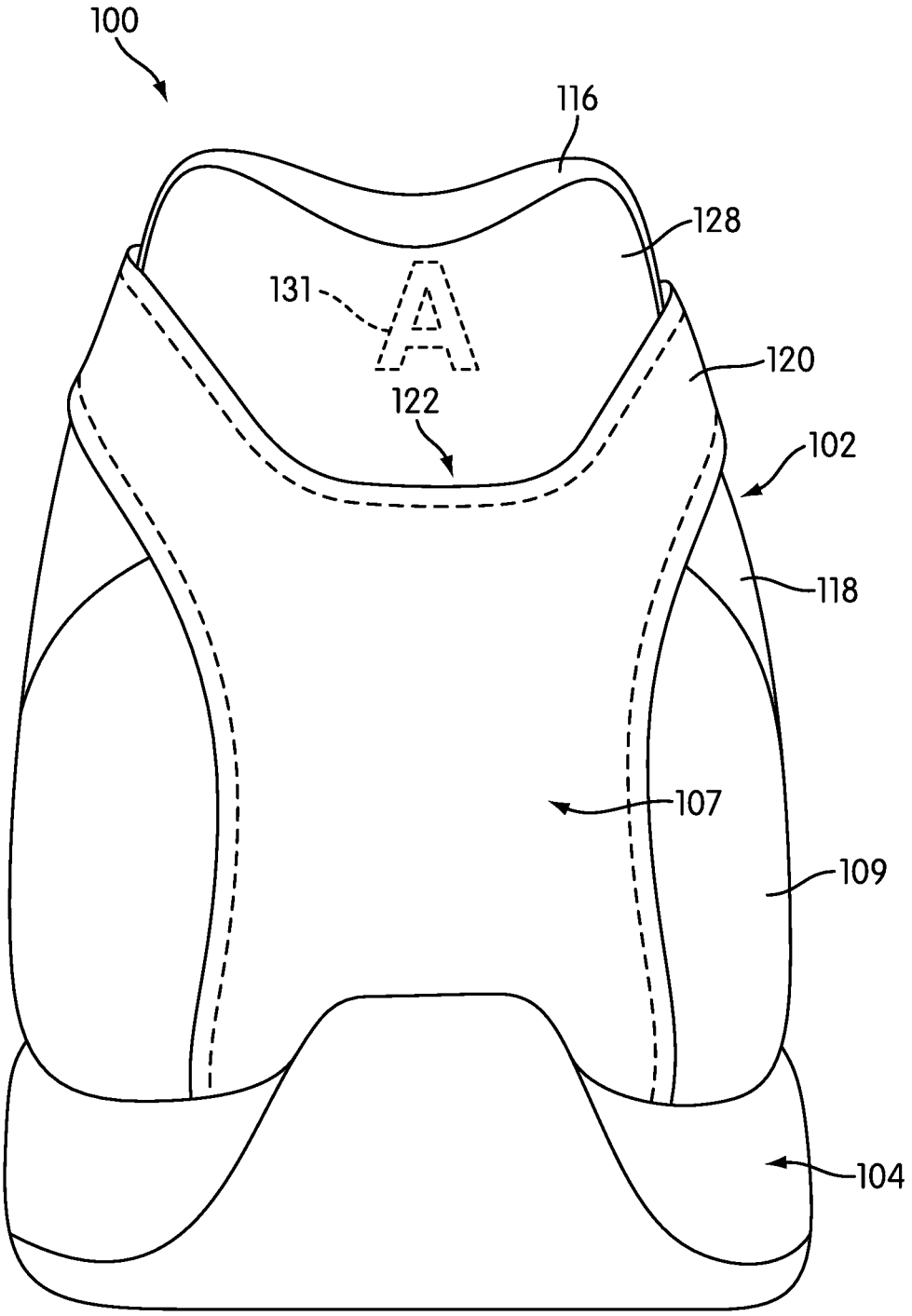
FIG. 4 is a rear view of the size-adjustable article of footwear with the removable heel member removed from the heel portion.
Figure 6:
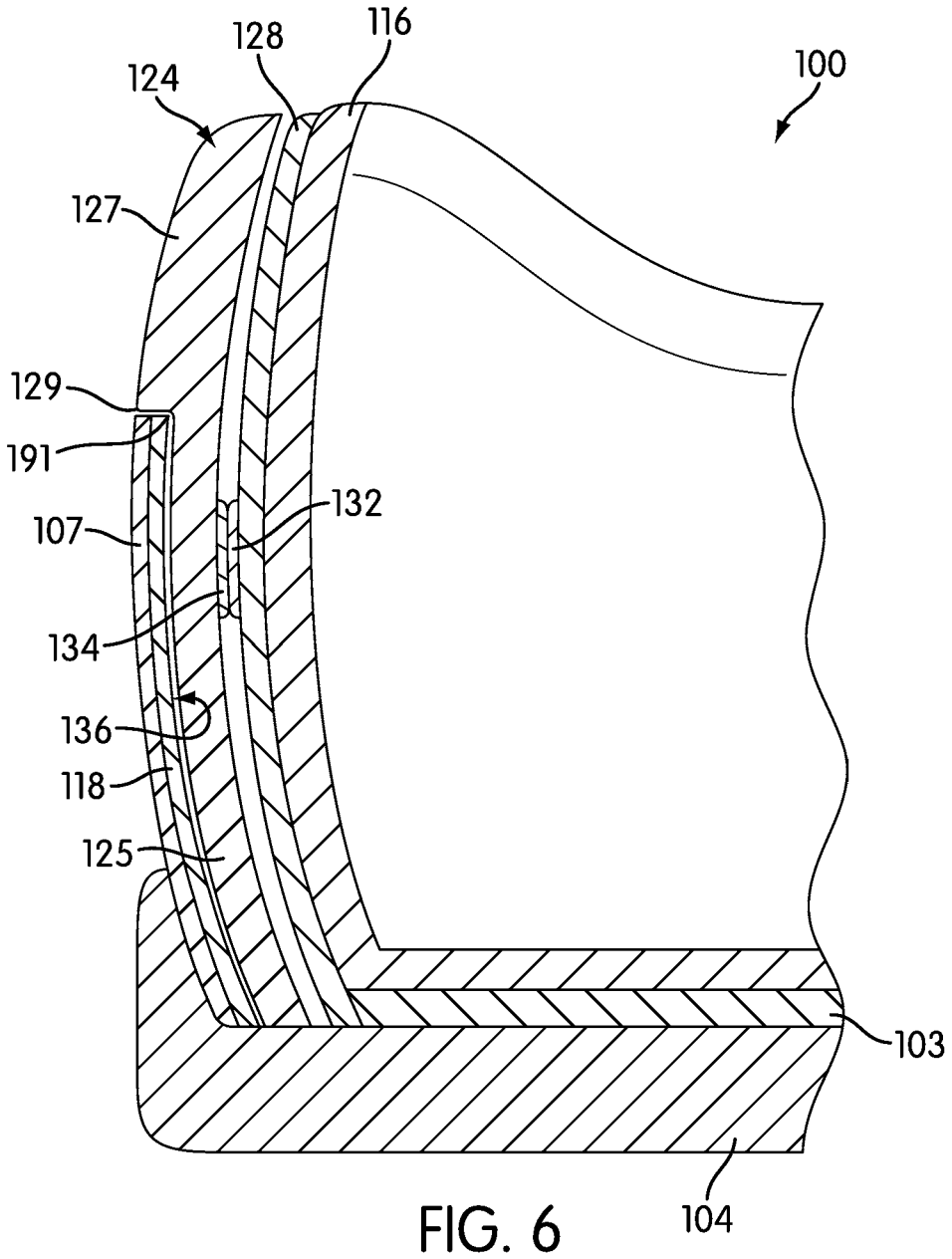
FIG. 6 is a side view of a cross-section of a portion of the size-adjustable article of footwear as shown in FIG. 5.
Figure 8:
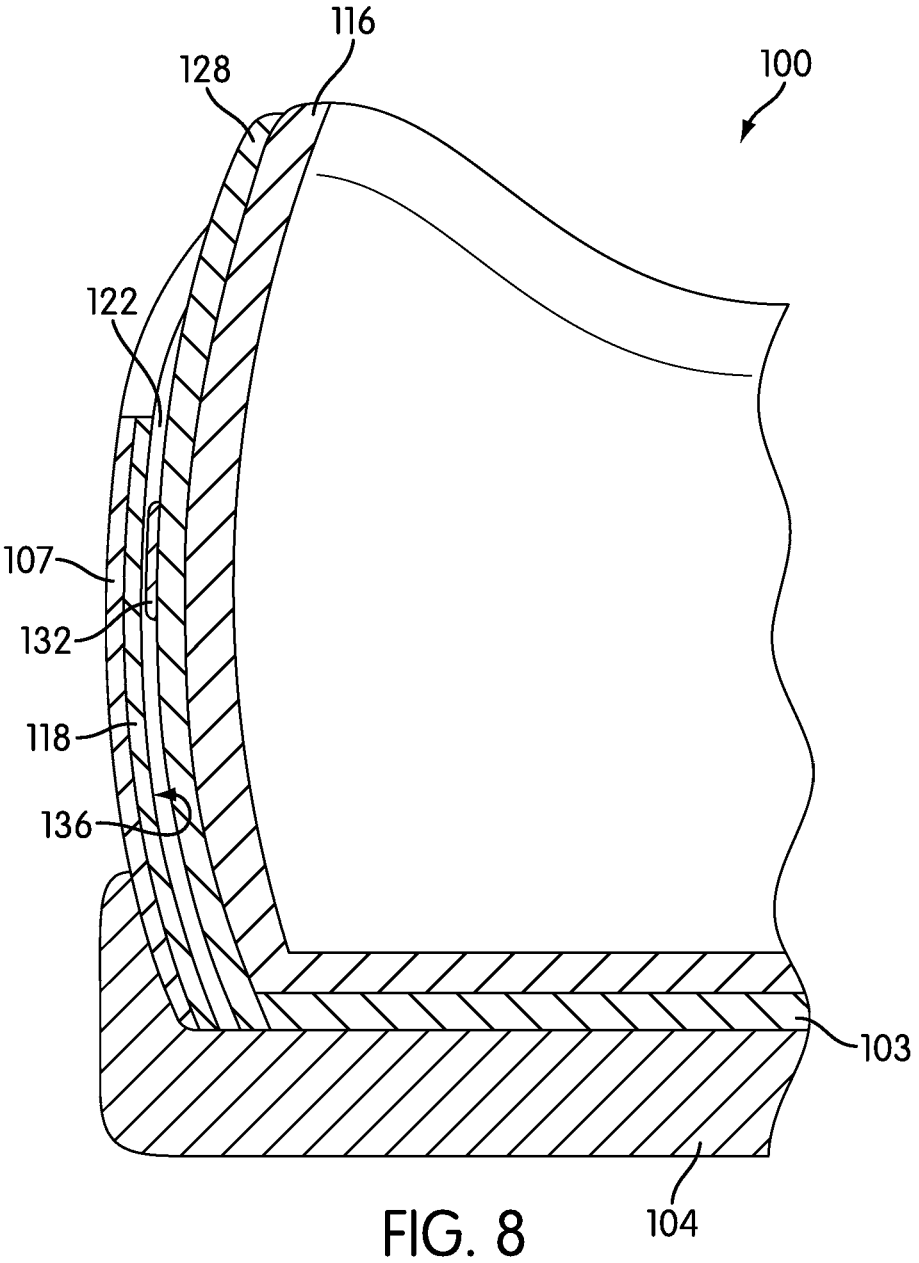
FIG. 8 is a side view of a cross-section of a portion of the size-adjustable article of footwear as shown in FIG. 7.

As shown best in FIGS. 6 and 8, pocket 122 is formed generally of two opposing surfaces: an first pocket surface 128 and an interior surface 136 of exterior shell 118. First pocket surface 128 extends above interior surface 136. As shown in FIG. 4, first pocket surface 128 is exposed to form a portion of the exterior surface of article of footwear 100 when no insert is provided in pocket 122. First pocket surface 128 may extend to sole 104, to midsole 103, or only partially toward sole 104 or midsole 103. First pocket surface 128 is preferably made from a durable material similar to or the same as the material forming exterior shell 118, such as leather, canvas, synthetic materials, or the like. A first attachment surface 132 is preferably provided on first pocket surface 128 for securing insert 124 within pocket 122. These securing provisions are described in greater detail below.

Interior surface 136 may be a lining attached to exterior shell 118 using any method known in the art, such as by stitching, with an adhesive, or the like. In other embodiments, interior surface 136 may be a unitary surface of exterior shell 118. In a preferred embodiment, interior surface 136 is made from a material capable of being secured to first attachment portion 132, such as cotton or synthetic woven or non-woven materials.

Pocket 122 is generally configured to receive a removable insert 124. Insert 124 is sized and shaped to shorten the effective length of article of footwear 100 when positioned within pocket 122. Similarly, when insert 124 is not positioned within pocket 122, the effective length of article of footwear 100 is increased. The amount or degree of increase or decrease in length may vary, but preferably insert 124 influences the size of article of footwear 100 by one-half size. For example, if article of footwear 100 has a no-insert size of 7, positioning insert 124 within pocket 122 may decrease the effective size of article of footwear 100 to 6.5. Similarly, if article of footwear 100 has an insert size of 7, removing insert 124 from pocket 122 may increase the effective size of article of footwear 100 to 7.5. In other embodiments, the increase or decrease in size may be larger or smaller than in this example.

Figure 9:
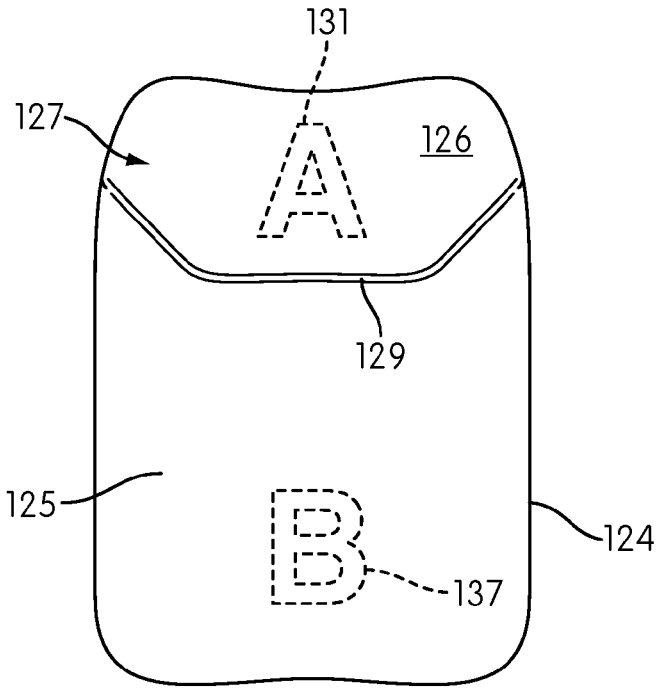
FIG. 9 is a front view of an embodiment of a removable heel member configured to be inserted into a heel portion of a size-adjustable article of footwear.
Figure 10:
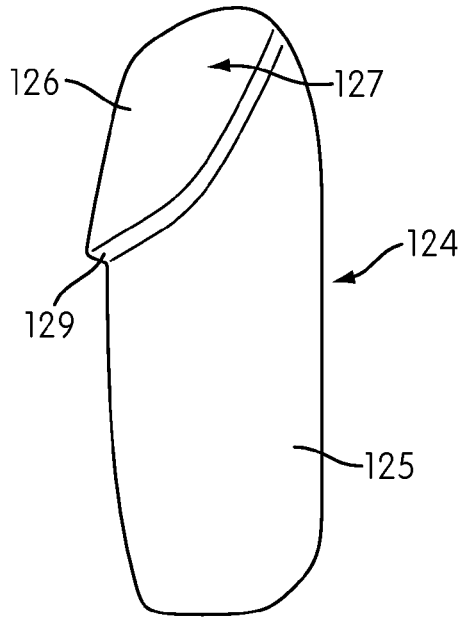
FIG. 10 is a side view of the removable heel member.
Figure 11:
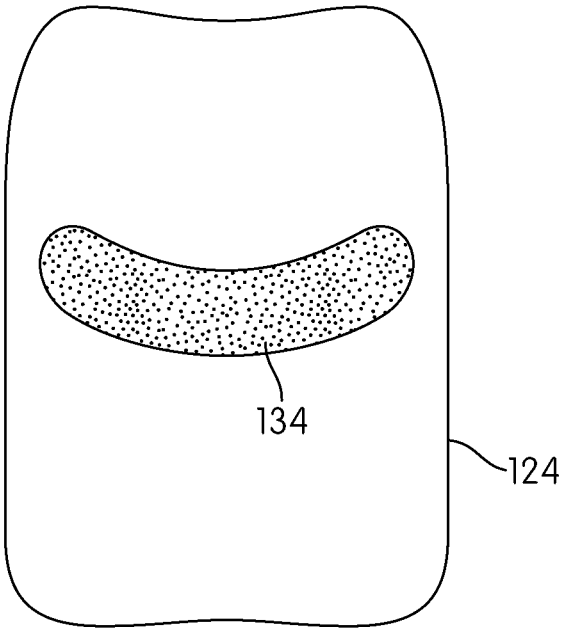
FIG. 11 is a rear view of the removable heel member.

FIGS. 9-11 show one embodiment of insert 124. In the embodiment shown, insert 124 generally includes a body 125 and an upper portion 127. Body 125 is generally configured to be inserted into pocket 122 while upper portion 127 is configured to remain outside of pocket 122. As shown best in FIG. 3, upper portion 127 includes an exterior surface 126 sized and shaped to become an exterior surface of article of footwear 100 when insert 124 is attached to article of footwear 100. Upper portion 127 may include a exterior design 131 on exterior surface 126, where exterior design 131 may be any type of design known in the art, such as a graphic, words, letters, logos, or the like. Exterior design 131 may be entirely aesthetic or may also include information, such as an owner's name, team affiliation, player number, or the like. Exterior design 131 may be applied to exterior surface using any method know in the art, such as printing, embossing, stitching, co-molding, overmolding, writing, or the like.

Similarly, insert body 125 may also include a body design 137. Body design 137 is similar to exterior design 131, in that body design 137 may be any type of design known in the art, formed or applied to insert body 125 using any method known in the art. In one embodiment, body design 137 may include sizing information and/or instructions for using insert 124, such as how to secure insert 124 within pocket 122, how to remove insert 124 from pocket easily, and/or how to clean insert 124 or article of footwear 100.

Although shown as a unitary piece in FIGS. 9-11, insert 124 may include multiple pieces. For example, insert 124 may include two or more pieces arranged back-to-front so that portions may be removed sequentially as the user's foot grows. In other embodiments, upper portion 127 of insert 124 may detach from insert body 125 so that exterior design 131 may be changed.

Figure 12:
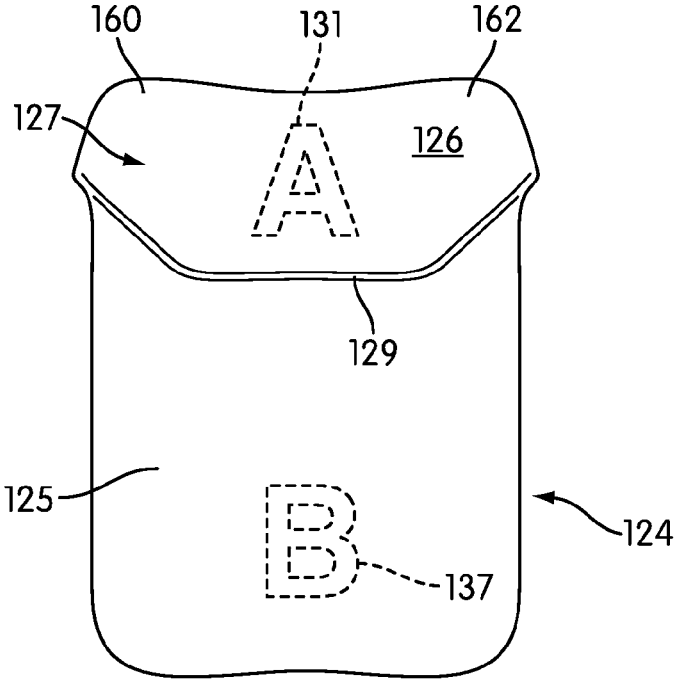
FIG. 12 is a front view of an embodiment of a removable heel member configured to be inserted into a heel portion of a size-adjustable article of footwear.
Figure 13:
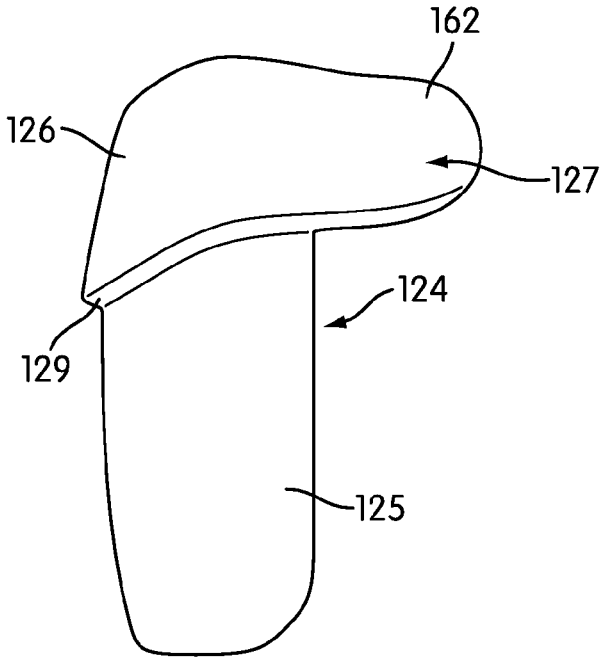
FIG. 13 is a side view of the embodiment of the removable heel member as shown in FIG. 12.
Figure 14:
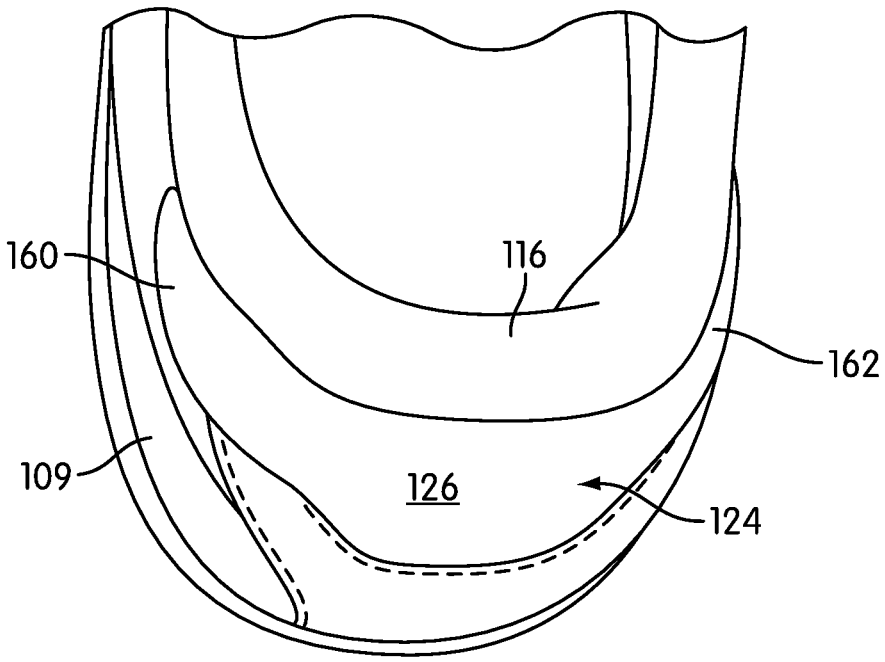
FIG. 14 is a top view of a heel portion of a shoe with a removable heel member as shown in FIG. 12 inserted into the heel portion.

FIGS. 12-14 show another embodiment of insert 124. Similar in many respects to the embodiment shown in FIGS. 9-11, insert 124 in the embodiment shown in FIGS. 12-14 includes an upper portion 127 associated with a body portion 125 to form a lip 129 that may rest on a portion of pocket 122. Upper portion 127 may include an exterior surface 126 on which an exterior design 131 may be positioned. Body portion 125 may include a body design 137. Upper portion 127 may wrap around to the sides of the article of footwear, as best shown in FIG. 14. Upper portion 127 may include a lateral extension 160 and a medial extension 162. Made of the same or similar materials as the remainder of upper portion 127, extensions 160 and 162 may assist in stabilizing the user's foot by decreasing the flexibility of the heel portion of the article of footwear, similar to the function provided by heel counter 109. In some embodiments, extensions 160 and 162 may be co-extensive with heel counter 109. Additionally, extensions 160 and 162 increase the available surface for placing an exterior design, such as exterior design 131, on upper portion 127.

Figure 3:
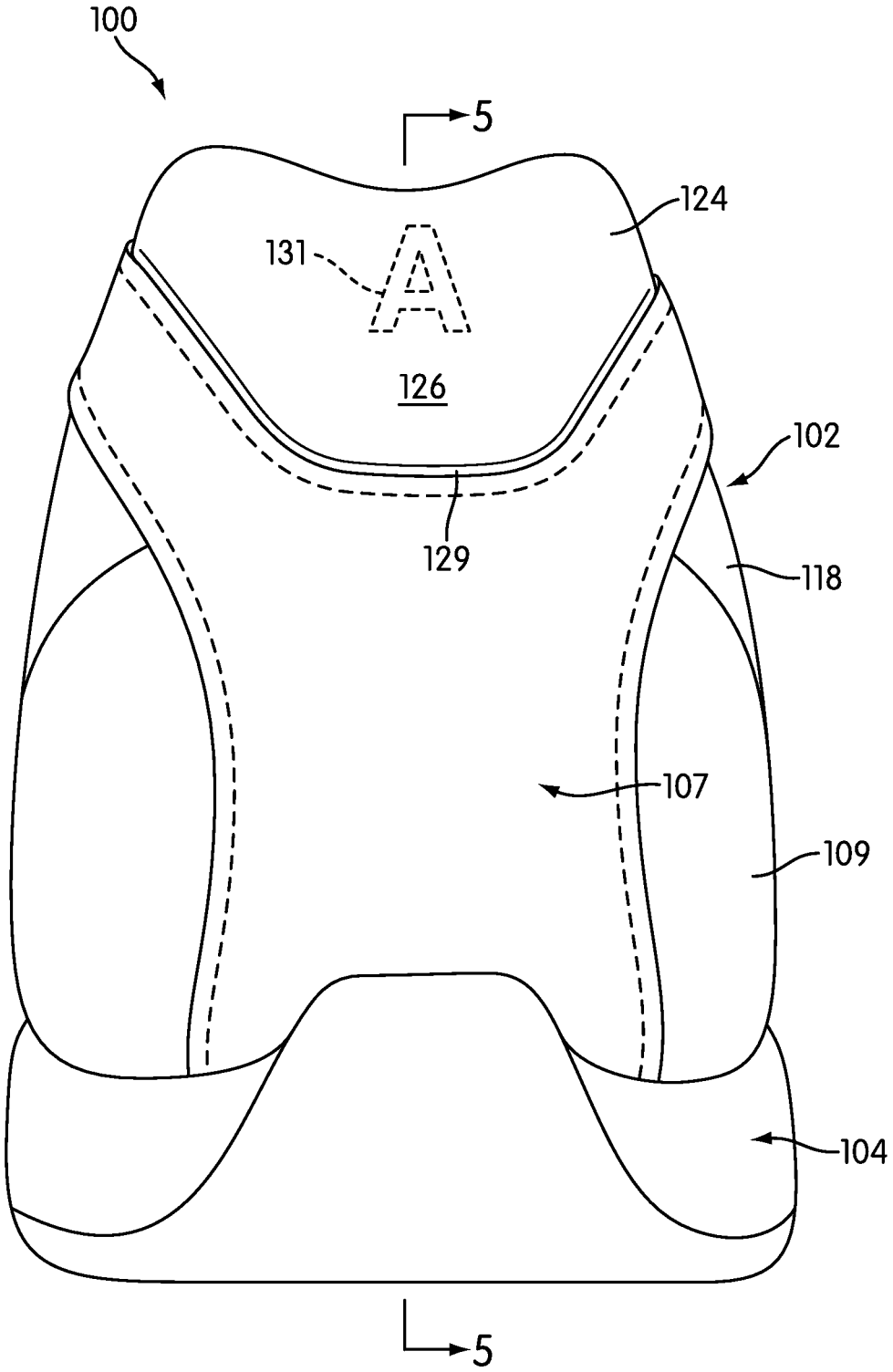
FIG. 3 is a rear view of the size-adjustable article of footwear with the removable heel member positioned in a heel portion.

Comparing FIGS. 3 and 4, upper portion 127 covers or substantially covers the exposed portion of first pocket surface 128 when insert 124 is positioned within pocket 122. Thus, when insert 124 is within pocket 122, upper portion 127 forms a portion of the exterior surface of article of footwear 100. This configuration allows a user to more easily grasp insert 124 for insertion into or removal from pocket 122. When insert 124 is not positioned within pocket 122, first pocket surface 128 forms that portion of the exterior surface of article of footwear 100. Exterior design 131 may be reproduced on first pocket surface 128, as shown in FIG. 4. When exterior design 131 is included on exterior surface 126, exterior design 131 is not lost when insert 124 is removed from pocket 122. In other embodiments, the design on first pocket surface 128 may be different from the design on exterior surface 126.

In the embodiment shown in the figures, first pocket surface 128 as backed by liner 116 is positioned to separate a wearer's foot, ankle, or Achilles tendon from insert 124 so that insert 124 does not irritate the wearer during use. In other words, the wearer's foot may be exposed only to liner 116 regardless of whether or not insert 124 is attached to article of footwear 100. This configuration provides for maximum wearer comfort due to the wicking properties of the material of liner 116 and cushioning properties.

In some embodiments, insert 124 is contoured to match the curvature of heel cup 107. Insert 124 is preferably made from a flexible material that can retain an original thickness while flexing. Maintaining the original thickness helps to keep a proper length-wise fit when a wearer is using insert 124. However, because the wearer's foot will flex and deform slightly while walking, running, or even standing, some flexibility in the material of insert 124 is preferred for comfort so that insert 124 allows for the changes in contour of the wearer's foot during use. For example, insert 124 may be made from rubber, silicone, or the like.

Body 125 and upper portion 127 of insert 124 have different thicknesses. The thickness of body 125 preferably corresponds to the desired change in length of article of footwear 100. Upper portion 127 is preferably thicker than body 125, forming a lip 129 between upper portion 127 and body 125. In use, upper portion 127 remains outside of pocket 122 while body 125 is inserted into pocket 122, as shown best in FIG. 6. When body 125 of insert 124 is disposed within pocket 122, lip 129 rests on an edge 131 of pocket 122 so that exterior surface 126 of insert 124 aligns or substantially aligns with the exterior surface of heel cup 107. This configuration allows for a smoothed exterior surface for article of footwear 100.

Figure 5:
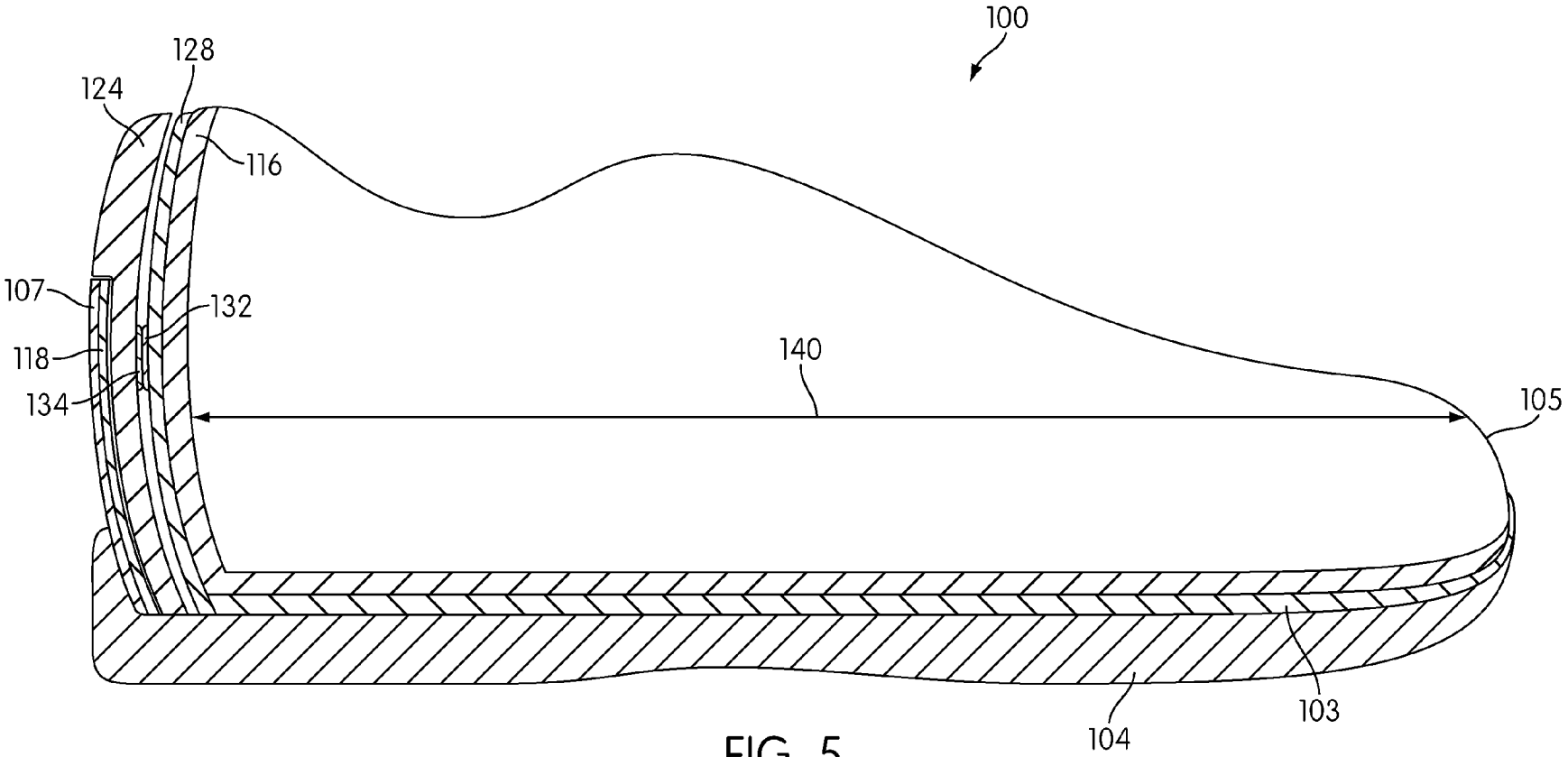
FIG. 5 is a side view of a cross-section of the size-adjustable article of footwear having a first interior length.

As shown in FIGS. 5, 6 and 11, body 125 may include provisions for attaching body to a surface of pocket 122. Such provisions may be included to stabilize and secure insert 124 within pocket 122 so that shifting of insert 124 with respect to pocket 122 is minimized. Similarly, the unintentional extraction of insert 124 is also minimized.

In the embodiment shown in the figures, the provisions for attaching body 125 to a surface of pocket 122 are provided on only one side of body 125, the side of body 125 facing liner 116. The provisions may be any type of mechanical fastener capable of being removably secured together, such as a button and buttonhole, a snap, or the like. In the embodiment shown in the figures, the provisions are preferably hook-and-loop-type fasteners, such as Velcro®. As is most clearly shown in FIG. 6, a first attachment portion 132 is fixedly attached to surface 128, such as with stitching, with an adhesive, or by welding. Preferably, first attachment portion 132 extends along and follows the contours of pocket 122 at edge 191.

A second attachment portion 134 is fixedly attached to body 125, such as with stitching, with an adhesive, or by gluing. Second attachment portion 134 is also shown in greater detail in FIG. 11. When body 125 of insert 124 is inserted into pocket 122, first attachment portion 132 is secured to second attachment portion 134, such as by pressing portions 132 and 134 together until first attachment portion 132 engages with second attachment portion 134. When a wearer wishes to remove insert 124 from pocket 122 the wearer may disengage first attachment portion 132 from second attachment portion 134, such as by peeling the two portions 132, 134 apart. In the embodiment shown in the figures, this may be achieved by grasping upper portion 127 between the fingers and pulling on insert 124 until portions 132 and 134 disengage.

Figure 7:
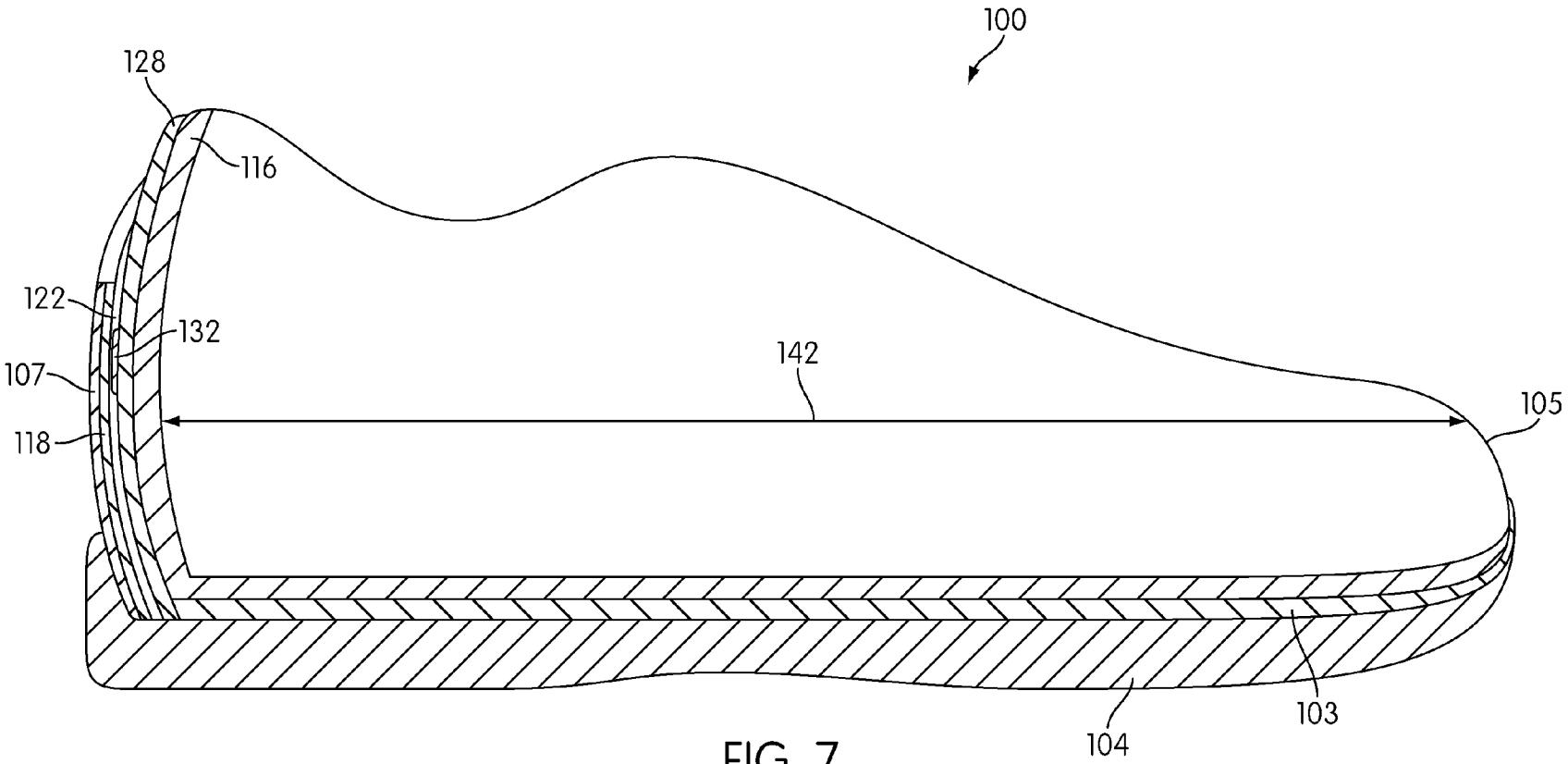
FIG. 7 is a side view of a cross-section of the size-adjustable article of footwear having a second interior length.

The size-adjustment capabilities of sizing system 120 is shown in greater detail in FIGS. 5-7. FIG. 5 shows insert 124 attached to article of footwear 100 so that upper portion 127 of insert 124 forms a part of the exterior surface of article of footwear 100. Insert 124 is positioned between lining 116 and heel cup 107. In this embodiment, more particularly, a portion of insert 124 is positioned within pocket 122, generally between pocket first pocket surface 128 and exterior shell 118. Lip 129 rests against surface 131. First attachment surface 132 is engaged with second attachment surface 134. The opposite face of body 125 is positioned against an interior surface 136 of exterior shell 118.

The insertion of insert 124 into pocket 122 uniformly pushes lining 116 in the heel region toward toe 105. Article of footwear 100 has a first effective length 140, i.e., a length available to a wearer's foot.

FIGS. 7-8 show article of footwear 100 with insert 124 removed. First pocket surface 128 now forms part of the exterior surface of article of footwear 100. First pocket surface 128 now abuts interior surface 136 of exterior shell 118. First attachment surface 132 is now engaged with interior surface 136, effectively closing pocket 122. The closing of pocket 122 is particularly effective when first attachment surface 132 extends along and follows the contours of pocket 122 at or near edge 191.

The removal of insert 124 allows liner 116 to expand towards exterior shell 118. A second effective length 142 of article of footwear 100 is now provided. Second effective length 142 is greater than first effective length 140 (shown in FIG. 6). In other words, the removal of insert 124 from pocket 122 increases the effective length of article of footwear 100.

In some embodiments, a portion of material may be provided to close or cover pocket 122 and form a portion of the exterior of the surface of article of footwear 100. FIGS. 15-18 show an embodiment of article of footwear 100 in which a flap 150 is provided to cover pocket 122, particularly when insert 124 is not inserted into pocket 122. Without insert 124 to close off the interior of pocket 122, debris, water, or other undesirable items may accumulate within pocket 122. Flap 150 may be provided to prevent such undesirable items from entering and/or remaining within pocket 122. In some embodiments, flap 150 may be provided to secure insert 124 within pocket 122, as well, by extending over insert 124. Flap 150 may be any type or portion of material known in the art, such as leather, vinyl, cotton, synthetic materials, or the like. Flap 150 may have a fixed length or may include or be made from an elastomeric or stretchy material, such as Lycra®, Spandex®, rubber, silicone, or the like.

Figure 15:
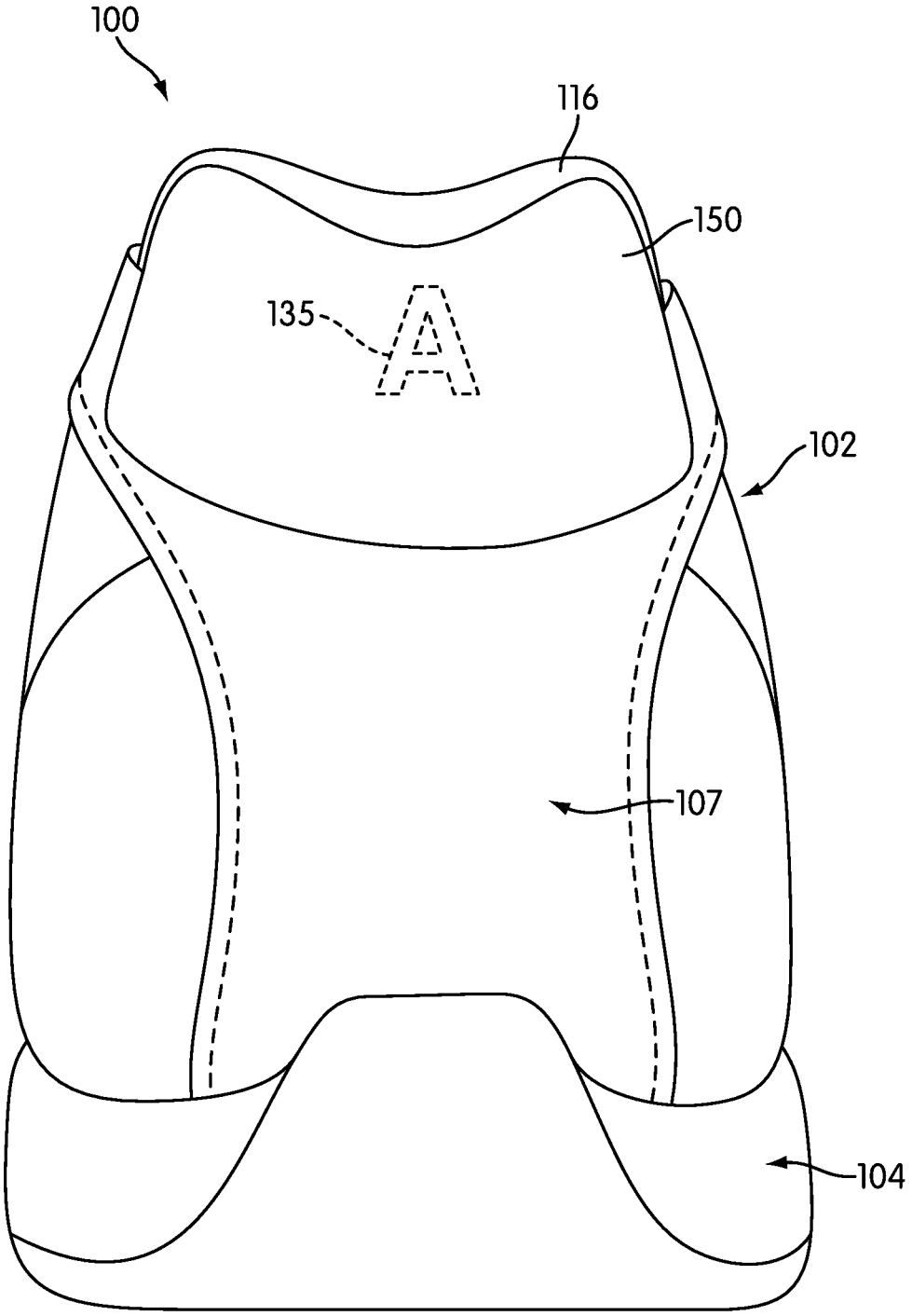
FIG. 15 is a rear view of an embodiment of an article of footwear having a pocket configured to receive a removable member, with a flap covering the pocket.
Figure 16:
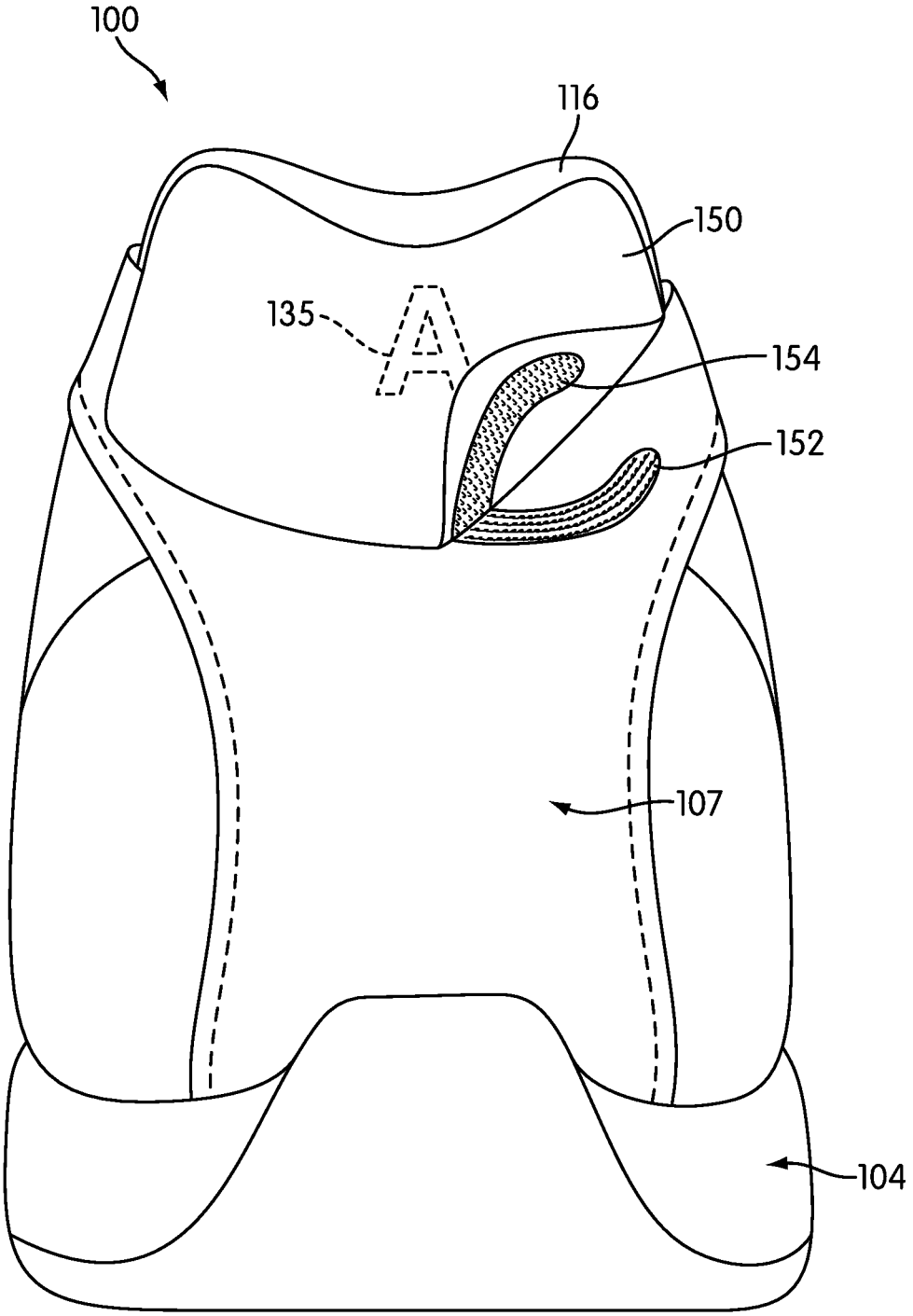
FIG. 16 is a rear view of the embodiment of the article of footwear as shown in FIG. 15, with a portion of the pocket lifted.

FIGS. 15 and 16 show rear views of article of footwear 100, showing flap 150 in a closed or partially closed position on upper 102. Flap 150 may be associated with sock liner 116, such as by being attached to sock liner 116. Flap 150 is positioned over the pocket, and resting on or otherwise associated with a portion of upper 102 at or near heel cup 107. In some embodiments, however, flap 150 may extend to sole 104. Flap 150 may include a flap design 135 that is similar to or the same as exterior design 131 so that exterior design 131 is not lost when insert 124 is removed. In other words, the appearance of article of footwear 100 may maintain characteristics with or without insert 124.

In some embodiments, as shown in FIG. 16, flap 150 may be secured to upper 102 using any securing mechanism known in the art, such as snaps, buttons, magnets or the like. In the embodiment show in FIG. 16, a hook-and-loop mechanism is provided for removably securing flap 150 to upper 102. A first portion 152 of the hook-and-loop mechanism is associated with upper 102, and a second portion 154 of the hook-and-loop mechanism is associated with flap 150. Flap 150 may be removably attached to upper 102 by engaging first portion 152 with second portion 154, such as by pressing portions 152 and 154 together. Flap 150 may be detached from upper 102 by disengaging portions 152 and 154, such as by peeling flap 150 away from upper 102.

Figure 17:
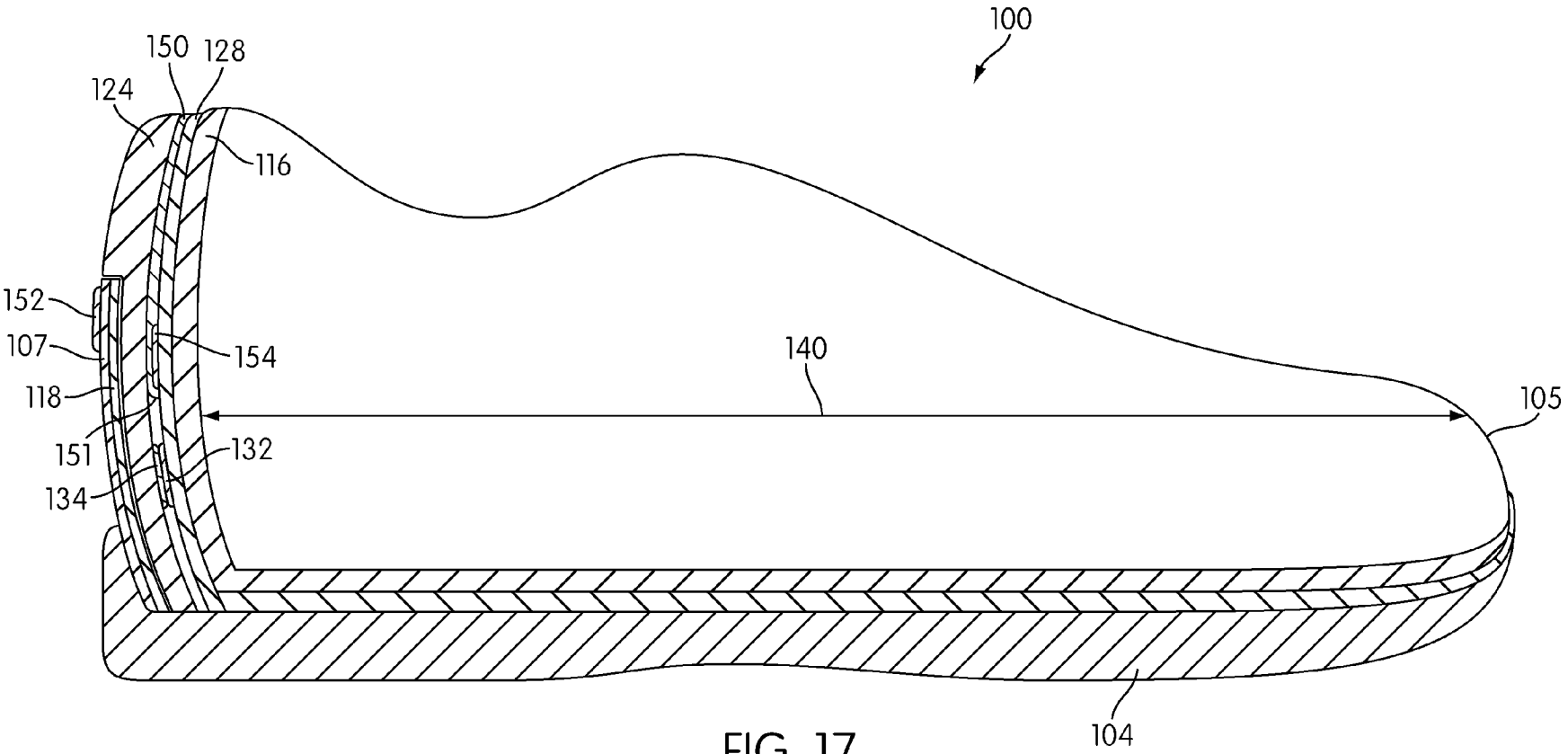
FIG. 17 is a longitudinal cross-sectional view of the article of footwear as shown in FIG. 15, with the insert positioned in the pocket and the flap positioned within the pocket.
Figure 18:
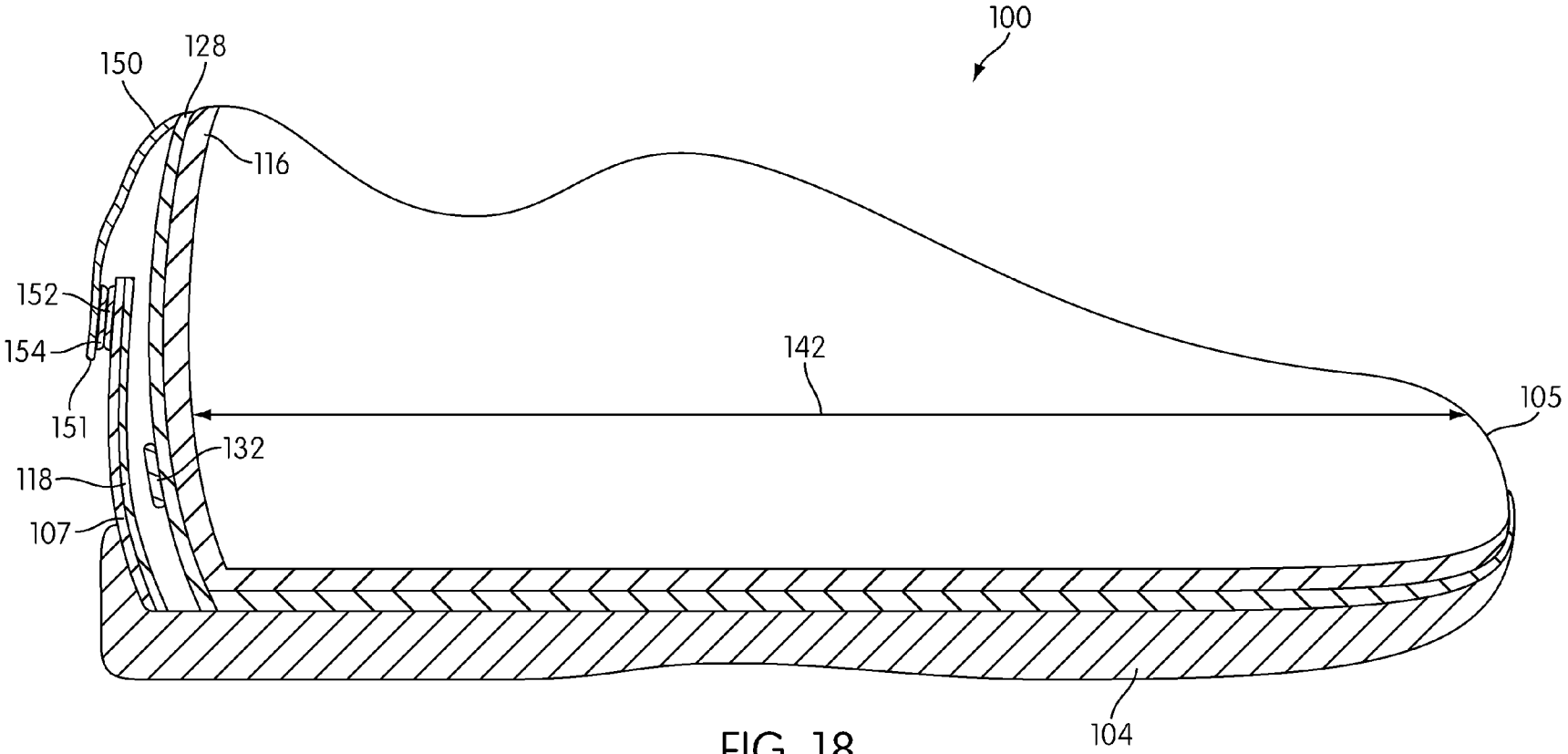
FIG. 18 is a longitudinal cross-sectional view of the article of footwear as shown in FIG. 15, with the insert removed and the flap extending over the pocket.

FIGS. 17 and 18 show one embodiment of how flap 150 may be positioned on and/or in article of footwear 100. In this embodiment, flap 150 does not extend over insert 124 when insert 124 is associated with article of footwear 100 to provide article of footwear 100 initial length 140, as shown in FIG. 17. Insert 124 is positioned between exterior shell 118 and exterior pocket surface 128 to push exterior pocket surface 128 toward toe 105. Flap 150 is positioned between insert 124 and pocket exterior surface 128. In other words, flap 150 may be tucked behind insert 124 until a user desires to utilize flap 150.

First portion 152 of the securing mechanism is exposed on heel cup 107, and second portion 154 of the securing mechanism is positioned between flap 150 and pocket exterior surface 128. In this embodiment, the length of flap 150 has been selected so as not to interfere with the attachment of first engaging surface 132 and second engaging surface 134 so that insert 124 may be secured to pocket exterior surface 128. In other words, a free end 151 of flap 150 does not reach first engaging surface 132. In this embodiment, flap 150 is made from a fixed-length material, such as leather, vinyl, or the like.

FIG. 18 shows article of footwear 100 after insert 124 has been removed. Pocket exterior surface 128 moves towards exterior shell 118 to provide adjusted length 142 between toe 105 and sock liner 116. Flap 150 has been positioned so that free end 151 is now on an opposite side of exterior shell 118 and heel cup 107. First portion 152 of the securing mechanism is engaged with second portion 154 of the securing mechanism. The void left by the removal of insert 124 has been closed.

Figure 19:
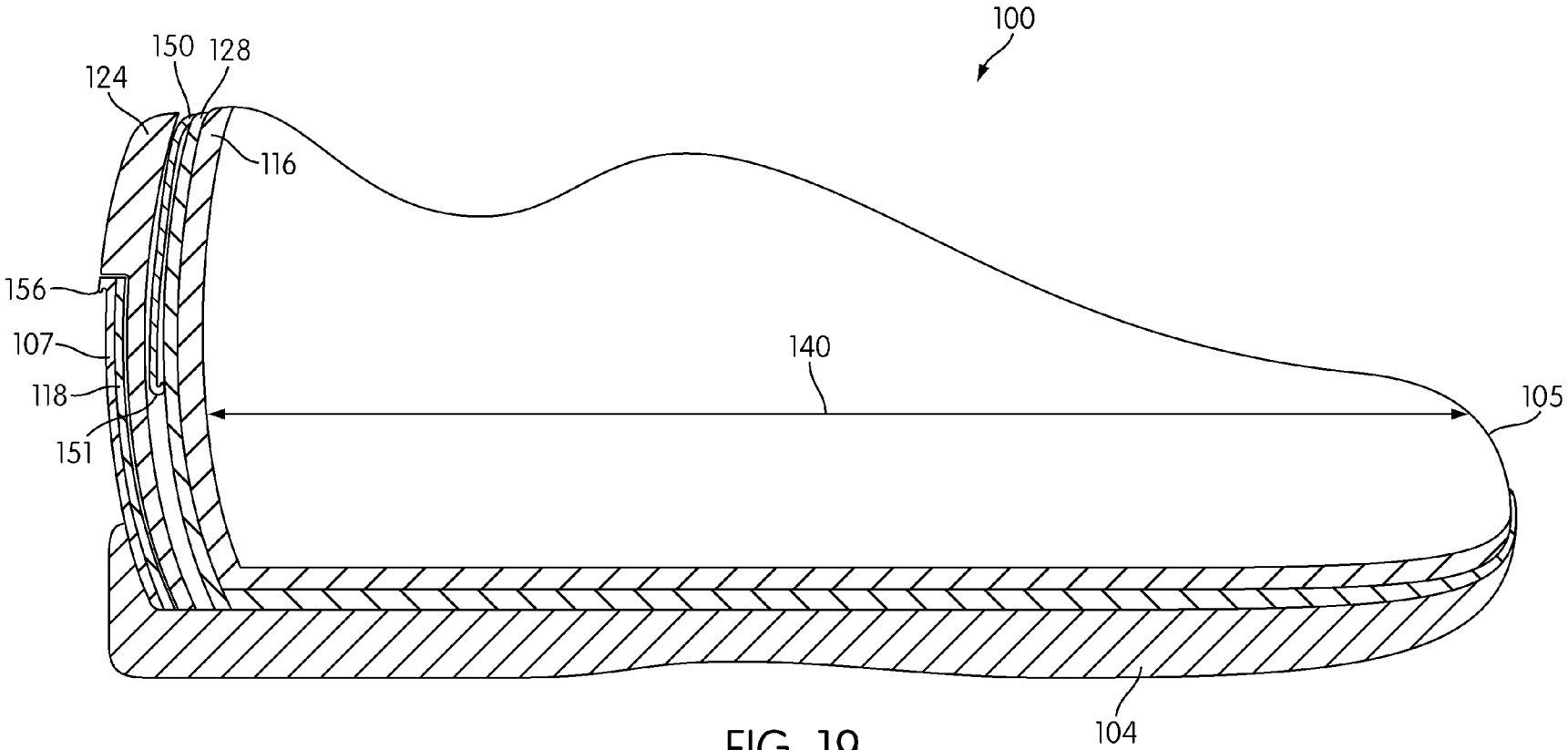
FIG. 19 is a longitudinal cross sectional view of an embodiment of an article of footwear configured to receive an insert in a pocket, shown with the insert within the pocket and an embodiment of a flap for closing the pocket positioned within the pocket.
Figure 20:
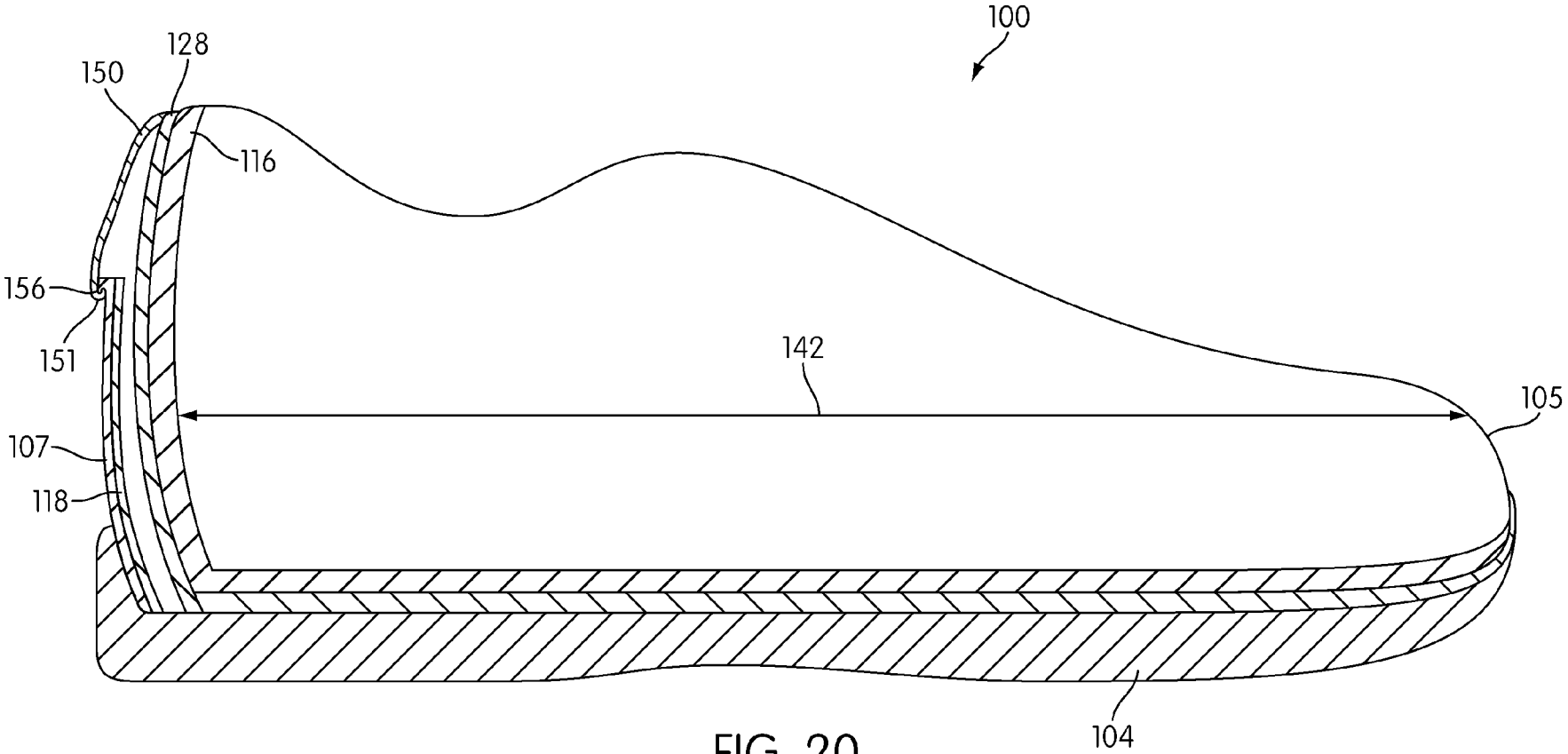
FIG. 20 is a longitudinal cross-sectional view of the embodiment of an article of footwear as shown in FIG. 19, with the insert removed and the flap stretched over the pocket.

FIGS. 19 and 20 show another embodiment of flap 150, where flap 150 is made from a material having elastomeric properties. FIG. 19 is similar to FIG. 17, where insert 124 is positioned between exterior shell 118 and exterior pocket surface 128 to push exterior pocket surface 128 toward toe 105. Flap 150 is positioned between insert 124 and pocket exterior surface 128. In this embodiment, the length of flap 150 has been selected so as not to interfere with the attachment of first engaging surface 132 and second engaging surface 134 so that insert 124 may be secured to pocket exterior surface 128. In other words, a free end 151 of flap 150 does not reach first engaging surface 132.

In this embodiment, the securing mechanism used to maintain the position of flap 150 on heel cup 107 includes a ridge 156 formed near where insert 124 rests on heel cup 107. Free end 151 of flap 150 may have a corresponding shape to that of ridge 156. When flap 150 is positioned to close the void left by the removal of insert 124, as shown in FIG. 20, free end 151 may be hooked onto or tucked beneath ridge 156 to removably secure flap 150 to heel cup 107. Once insert 124 has been removed, pocket exterior surface 128 moves towards exterior shell 118 to increase the length between toe 105 and sock liner 116 to adjusted length 142.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A size-adjustable article of footwear, comprising:

an upper having a first effective length when a removable member is positioned within a pocket in a heel portion of the article of footwear and a second effective length when the removable member is removed from the pocket, wherein the removable member forms a portion of an exterior surface of the article of footwear when positioned within the pocket, and wherein the pocket is defined by a first surface facing a second surface, the first surface extending vertically further than the second surface to an upper edge;

wherein, when the removable member is removed from the pocket, the portion of the first surface extending vertically further than the second surface forms the portion of the exterior surface of the article of footwear that is formed by the removable member when the removable member is positioned within the pocket;

wherein, when the removable member is positioned within the pocket, the removable member substantially covers the portion of the first surface that extends vertically further than the second surface such that the removable member extends to the upper edge of the first surface of the pocket;

wherein the heel portion of the article of footwear has a curvature; and wherein, the removable member is configured to substantially maintain the same shape inside the pocket and outside the pocket such that, when the removable member is removed from the pocket, the removable member is contoured to match the curvature of the heel portion of the article of footwear.

2. The article of footwear of claim 1, wherein the pocket is formed between a liner and an outer layer.

3. The article of footwear of claim 2, wherein the pocket extends to a sole of the article of footwear.

4. The article of footwear of claim 2, wherein at least a portion of the pocket is positioned at a point furthest from a toe region of the article of footwear.

5. The article of footwear of claim 1, wherein the removable member is configured to be secured within the pocket.

6. The article of footwear of claim 5, wherein the removable member is secured within the pocket using a mechanical fastener.

7. The article of footwear of claim 1, wherein the pocket is configured to be substantially closed when the removable member is removed from the pocket.

8. The article of footwear of claim 7, wherein the pocket is closed using a mechanical fastener.

9. The article of footwear of claim 8, wherein the mechanical fastener comprises a hook-and-loop fastener.

10. The article of footwear of claim 1 further comprising a flap configured to extend over the pocket.

11. The article of footwear of claim 1, wherein the removable member is removably secured within the pocket.

12. An article of footwear comprising:

an upper comprising an outer shell and a liner disposed at least partially within the outer shell, the liner configured to contact a foot of a wearer; and wherein the article of footwear includes a size adjustment system including an insert and a pocket formed between the liner and the outer shell in a heel region of the upper, the pocket configured to receive the insert, and the insert being configured to alter an effective length of the article of footwear, the insert having a body portion having a first thickness and an upper portion having a second thickness that is thicker than the first thickness of the body portion of the insert;

wherein the heel region of the upper has a first exterior surface and an upper-most edge;

wherein the upper portion of the insert has a second exterior surface that is aligned with the first exterior surface when the insert is positioned within the pocket;

wherein inserting the insert into the pocket changes the effective length of the article of footwear by a distance substantially the same as the first thickness of the body portion of the insert; and wherein the insert includes an upper edge that is aligned with the upper-most edge of the heel region of the upper when the insert is inserted into the pocket.

13. The article of footwear according to claim 12, wherein at least a portion of the pocket is positioned at a point on the article of footwear furthest from a toe region of the article of footwear.

14. The article of footwear of claim 12, the pocket comprising a first surface facing a second surface, wherein a portion of the first surface extends vertically further than the second surface.

15. The article of footwear of claim 14 further comprising a mechanical fastener, wherein a first portion of the mechanical fastener is configured to substantially close the pocket when engaged with the second surface.

16. The article of footwear of claim 15, wherein the first portion of the mechanical fastener is configured to engage with a second portion of the mechanical fastener positioned on the insert.

17. The article of footwear of claim 12 further comprising a flap configured to extend over the pocket.

18. The article of footwear of claim 12, wherein the pocket extends to a sole of the article of footwear.

19. The article of footwear of claim 12, wherein the insert is removably secured within the pocket.

20. The article of footwear of claim 12, wherein the pocket is configured to be substantially closed when the insert is removed from the pocket.

21. The article of footwear of claim 12, wherein the upper portion of the insert includes an upward-facing surface that is exposed when the insert is inserted in the pocket.

22. The article of footwear of claim 12, wherein a transition between the upper portion of the insert and the body portion of the insert forms a lip that is configured to rest on a portion of the pocket when the insert is inserted in the pocket.

* * * * *